US007150121B1

(12) United States Patent
Clay

(10) Patent No.: US 7,150,121 B1
(45) Date of Patent: Dec. 19, 2006

(54) ONE-PIECE TRIGGER FOR LEVER ACTION RIFLE WITH EXPOSED HAMMER

(76) Inventor: David R. Clay, 809 Harris Rd., Arlington, TX (US) 76001

( * ) Notice: Subject to any disclaimer, the term of this patent is extended or adjusted under 35 U.S.C. 154(b) by 96 days.

(21) Appl. No.: 10/622,931

(22) Filed: Jul. 18, 2003

Related U.S. Application Data

(60) Provisional application No. 60/396,675, filed on Jul. 18, 2002.

(51) Int. Cl.
*F41A 19/00* (2006.01)

(52) U.S. Cl. ..... 42/69.01; 42/69.03; 42/20

(58) Field of Classification Search ..... 42/69.01, 42/69.03, 20, 65
See application file for complete search history.

(56) References Cited

U.S. PATENT DOCUMENTS

| | | | | | |
|---|---|---|---|---|---|
| 371,455 | A | * | 10/1887 | Hepburn | 42/21 |
| 434,062 | A | * | 8/1890 | Hepburn | 42/21 |
| 1,790,482 | A | * | 1/1931 | Mossberg | 42/28 |
| 2,406,980 | A | * | 9/1946 | Young | 42/69.01 |
| 2,406,981 | A | * | 9/1946 | Young | 42/69.01 |
| 2003/0172571 | A1 | * | 9/2003 | West | 42/69.01 |

* cited by examiner

*Primary Examiner*—M. Thomson
(74) *Attorney, Agent, or Firm*—Jeffrey N. Collins

(57) ABSTRACT

The present invention comprises a new and improved one-piece trigger for a lever action rifle which eliminates trigger flop found on two piece factory triggers. The trigger allows the sear to slip up and past the half and full cock notches on the hammer via an elliptically shaped rigger pivot hole.

4 Claims, 4 Drawing Sheets

ONE-PIECE TRIGGER FOR LEVER ACTION RIFLE WITH EXPOSED HAMMER

CROSS REFERENCE TO RELATED APPLICATIONS

Priority is claimed from provisional application U.S. Ser. No. 60/396,675 filed on Jul. 18, 2002, and incorporated by reference herein.

FIELD OF THE INVENTION

In general, the present invention relates to firearms. More particularly, the present invention relates to an improved one-piece trigger for a lever action rifle having an exposed hammer.

DESCRIPTON OF THE PRIOR ART

All rifles are equipped with a standard trigger that is designed by the manufacturer and installed at the factory. The "factory trigger" is entirely adequate for the average shooter, however, many shooters especially hunters and target shooters demand a better trigger action than is offered by the standard factory trigger. The perceived shortcomings of factory triggers usually consist of non-uniform trigger pull (creep and backlash), overtravel, heavy trigger pull and in the specific case of the MARLIN 336™ rifles the shortcoming is trigger flop. Trigger flop is caused by the design of the trigger installed on these rifles.

The MARLIN 336™ rifle is a lever action rifle. Manipulating a lever located on the underside of the rifle operates the action. When the lever is opened downward the bolt is opened cocking an exposed hammer which pivots rotatibly around a hammer screw. The hammer has two operating positions created by notches, which the sear of the trigger slips into, as the hammer is cocked. The first position is the half cock position. When the hammer is in the half cock position the rifle is considered safe. The shape of the half-cock notch locks the sear against the hammer and prevents the trigger from being pulled to fire the weapon. The second position of the hammer is the full cocked position. When the hammer is fully cocked, pulling the trigger will release the hammer and fire the weapon. A second safety feature on the MARLIN 336™ rifle is a trigger safety block. The trigger safety block stops the trigger from being pulled prior to the lever being fully closed and the bolt completely locked up inside the receiver. The trigger cannot be pulled to allow the sear to release the hammer and fire the weapon unless the lever is fully closed deactivating the trigger safety block.

In order to allow the weapon to be cocked without the operator having to pull the trigger to clear the notches as the hammer is cocked, the factory Marlin™ trigger is built of two separate pieces as shown in prior art FIGS. 6 & 7 of the present invention. The first piece is called the trigger shoe 94. The second piece is called the sear 92. The trigger shoe extends downwardly below the receiver and is the part of the trigger that is seen and pulled by the shooter to fire the weapon. The sear is hidden inside the receiver of the rifle and is the part which makes contact with the notches on the hammer holding it in its cocked position until the shooter releases it by pulling the trigger to fire the weapon. The two-pieces are pivotally attached two each other and pivot together over the trigger pin. The two-piece design allows the sear to move forward independently of the trigger to slip over the cock and half-cock notch on the hammer as it is cocked, even though the sear can slip over the notches it cannot move forward to release the hammer until the trigger is physically pulled. The trigger cannot be pulled until the lever is fully closed and the trigger safety block is depressed. While the two piece design functions reliably it allows the trigger to flop forward when the rifle is cocked prior to shooting.

Many target shooters and hunters find the floppy trigger distracting and detrimental to good marksmanship. The two piece design of the factory Marlin 336™ trigger is inherently more prone to failure than a one-piece design. This is due to the potential of dirt and powder residue build up and impede the function of the trigger. The two piece design is also more prone to mechanical failure because of the greater number of small parts that could fail. Additionally, the manufacture of a two piece trigger requires additional steps to machine the parts and assemble them into a finished rifle, making the rifle more expensive and less profitable to manufacture. Efforts of others to eliminate the trigger flop of the Marlin 336™ rifle have centered on improving or changing the design of the factory trigger.

One such effort is that of WILDWEST GUNS™ of Anchorage, Ak. Their product the HAPPY TRIGGER™ shown in prior art FIG. 12 of the present invention eliminates the trigger flop of the Marlin™ trigger, however, it still incorporates multiple pieces in its design and manufacture. While an improvement over the factory trigger, the WILD WEST GUNS™ trigger is still composed of two or more pieces, and thus, is not as inherently reliable or as efficient to manufacture as a one-piece design would be.

Thus, there is a need for an improved one-piece trigger for a lever action rifle such as but not limited to the Marlin 336™ rifle that eliminates the floppy trigger, is more reliable in operation and is less expensive to manufacture and assemble.

SUMMARY OF THE INVENTION

In view of the above described disadvantages inherent in the triggers for the Marlin 336™ lever action rifle of the prior art, the present invention not only prevents the flop present in the standard factory trigger, but is also inherently more durable and less expensive to manufacture and assemble due to its one-piece design. As such, the general purpose of the present invention, which will be described subsequently in greater detail, is to provide a new and improved one-piece trigger for a lever action rifle, such as the Marlin 336™ which has all of the advantages of the prior art and none of the disadvantages.

To attain this purpose the present invention essentially comprises a trigger shoe and sear machined from a single piece of steel or other metal of suitable hardness and durability. The design innovation that allows the sear to slip over the notches as the hammer is cocked and yet not be able to be pulled until the trigger block is depressed, is a change in the dimension and shape of the trigger pin hole. This change allows for variable geometry of the relationship between the trigger and the hammer during the operating cycle of the trigger. Variable geometry of the trigger is achieved by altering the trigger pin pivot hole from a round hole sized to fit the round trigger pin tightly, to an elliptical or oval shaped pivot hole. The elliptically shaped trigger pin pivot hole allows the trigger and sear to slip up and out slightly as the hammer is cocked giving enough clearance for the sear to slip over the half-cock and full-cock notches on the hammer. When the hammer is fully cocked spring tension from a mainspring forces the trigger back down into its original position where the sear cannot move forward until after the lever is fully closed releasing the trigger block and the trigger is pulled by the shooter.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, an object of the present invention to provide a new and improved trigger for a lever action rifle such as but not limited to the MARLIN 336™ which eliminates the trigger flop found on the factory trigger.

It is a further object of the present invention to provide a trigger for a lever action rifle such as but not limited to the MARLIN 336™ that is less costly and more efficient to manufacture.

An even further object of the present invention is to provide a new and improved trigger for a lever action rifle such as but not limited to the MARLIN 336™ which is less costly to assemble into the finished rifle.

Still another object of the present invention is to provide a new and improved trigger for a lever action rifle such as but not limited to the MARLIN 336™ which provides a lighter and crisper trigger feel to the shooter than the factory trigger.

Another object of the present invention is to provide a new and improved trigger for a lever action rifle such as but not limited to the MARLIN 336™, which is stronger and more durable than the factory trigger.

Yet another object of the present invention is to provide a new and improved trigger for a lever action rifle such as but not limited to the MARLIN 336™ which is more reliable than the factory trigger.

An even further object of the present invention is to provide a new and improved trigger a lever action rifle such as but not limited to the MARLIN 336™ I with simplified operation and fewer parts than the prior art.

A still further object of the present invention is to provide a new and improved one piece trigger for a lever action rifle which may be installed and adjusted without the need of hiring a gunsmith.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS AND DRAWINGS

DETAILED DESCRIPTION OF THE PREFERRED EMBODIMENTS

Figure 1:
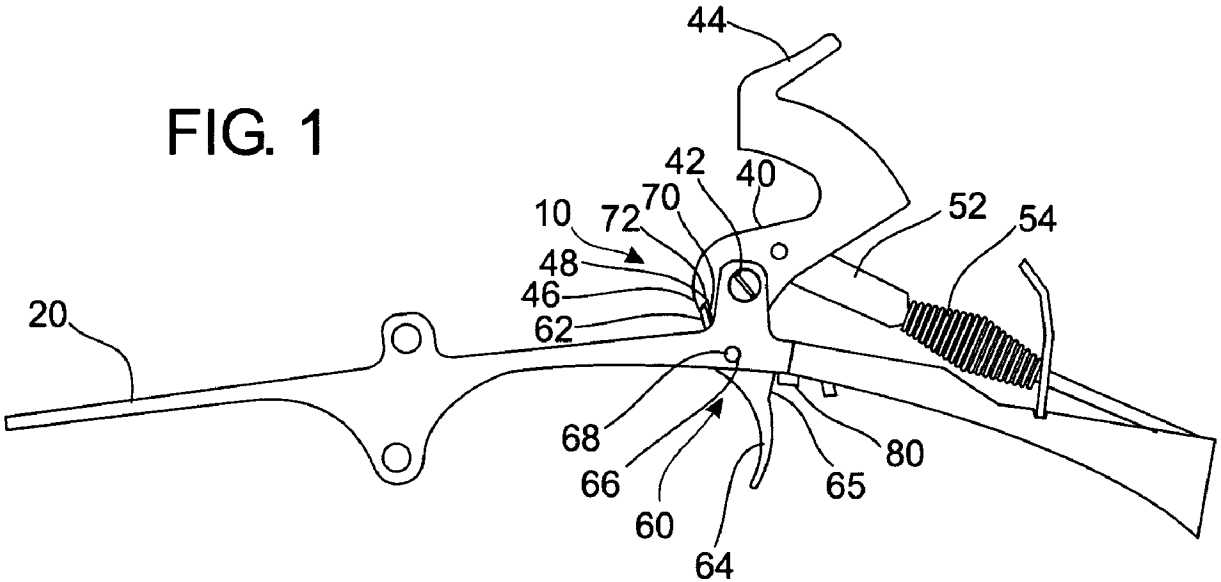
FIG. 1 is pen and ink drawing of a preferred embodiment of the invention installed in the trigger floor plate of the rifle and showing the relationship between the trigger and the hammer.
Figure 2:
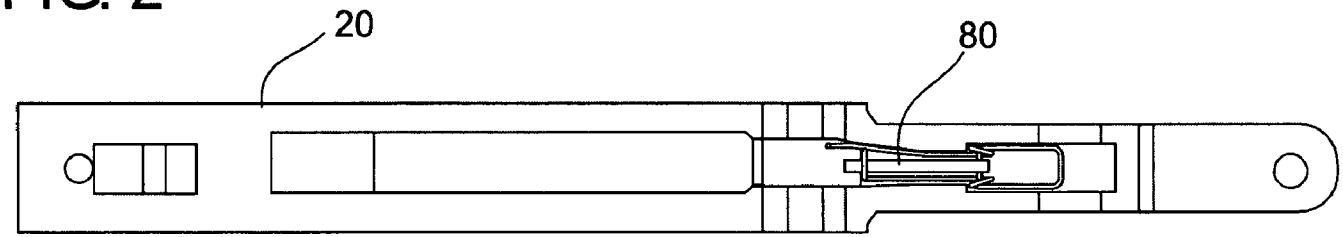
FIG. 2 is a pictorial illustration of the trigger floor plate which the trigger and hammer are installed in showing the hammer block mechanism.
Figure 3:
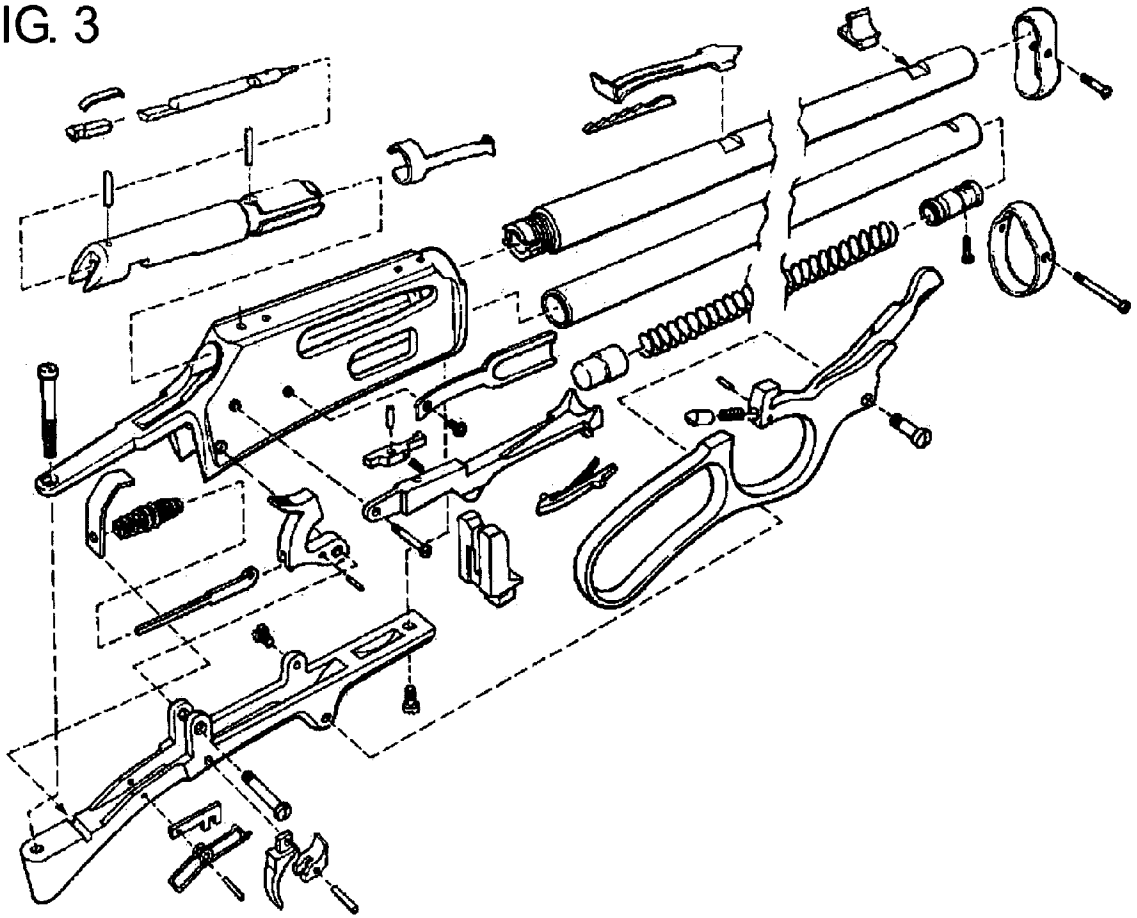
FIG. 3 is a schematic diagram and parts list for a MARLIN 336™ lever action rifle showing the relationship of parts discussed in the present application to each other.

Referring now to FIG. 1 and FIG. 2 is a trigger group 10 of a lever action rifle depicted in FIG. 3. The trigger group 10 is comprised of a trigger guard plate 20, a hammer 40, a one-piece trigger 60 and a trigger safety block 80. The trigger guard plate 20 forms part of the rifle receiver as shown in FIG. 3. Mounted in the trigger guard plate 20 are the hammer 40, and the one-piece trigger 60 and the trigger safety block 80.

Figure 4:
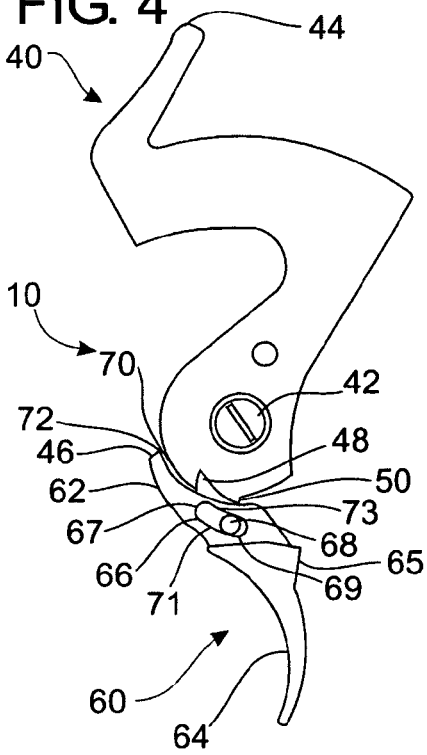
FIG. 4 is a pen and ink drawing of the invention showing the relationship of the hammer and trigger as the hammer is being cocked.

Still referring to FIG. 1, the hammer 40 pivots on a hammer screw 42 and has a spur 44 to which thumb pressure is applied to cock the hammer 40 and a convex surface 46 which pivots against a concave surface 70 of a sear 62 of the one-piece trigger 60. Located on the convex surface 46 is a half-cock notch 48 and a full-cock notch 50 (FIG. 4). The one-piece trigger 60 is mounted in the trigger guard plate 20 as shown in FIG. 1.

Figure 5:
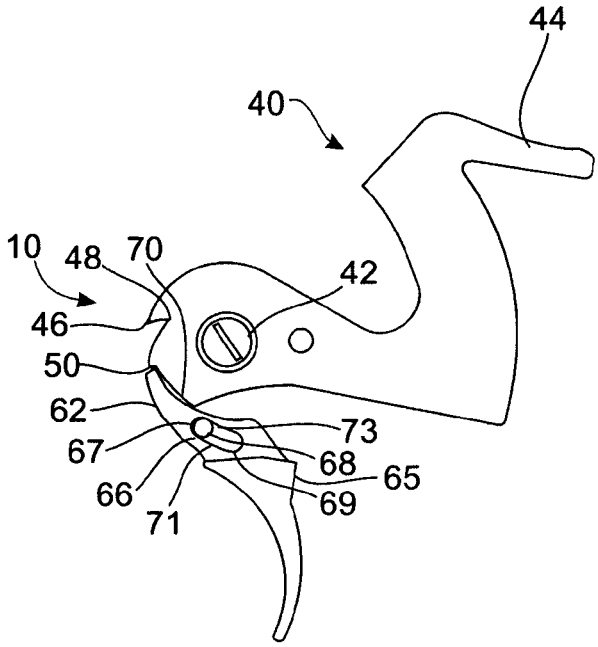
FIG. 5 is a pen and ink drawing of the invention showing the relationship of the hammer and trigger when the hammer is completely cocked.
Figure 6:
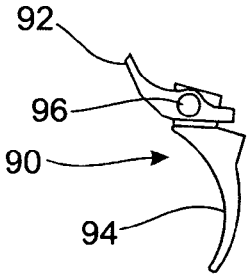
FIG. 6 PRIOR ART
FIG. 6 is a pen and ink drawing showing the prior art (factory trigger) as the parts are assembled.
Figure 7:
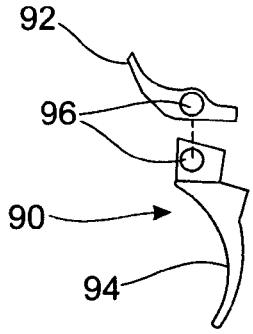
FIG. 7 PRIOR ART
FIG. 7 is a pen and ink drawing showing the individual parts of the prior art (factory trigger).

Shown in FIGS. 4 and 5, the one-piece trigger 60 consists of the sear 62, a trigger shoe 64, a rear surface 65 and a trigger pivot hole 66. The rear surface 65 is dimensioned to interact with the trigger safety block 80 to prevent the trigger 60 from being pulled prior to the lever (not shown) being fully closed. The trigger pivot hole 66 is shaped generally in an oblong or oval shape. The trigger pivot hole 66 has a first end 67, a second end 69, a bottom side 71, and a topside 73. The first end 67 and the second end 69 are sized so that a round trigger pin 68 fits tightly when it is positioned at either first end 67 or second end 69. The bottom side 71 and the topside 73 are elongated to create the oval or oblong shape of the trigger pivot hole 66. Additionally the bottom side 71 and the topside 73 are curved slightly so that the curvature of the bottom side 71 and the topside 73 matches the curvature of the concave surface 70 of the sear 62. The sear 62 also has a point 72. The one-piece trigger 60 pivots on the round trigger pin 68 that passes through the trigger pivot hole 66 and is secured to the trigger guard plate 20 as shown in FIG. 1.

The hammer 40 and the one-piece trigger 60 of FIG. 1 work together to control the firing of the rifle shown in FIG. 3. As the hammer is cocked (shown in FIGS. 1, 4 & 5) the convex surface 46 of the hammer 40 rotates against the concave surface 70 of the sear 62. The one-piece trigger 60 shifts from its starting position biased against the first end 67 of the trigger pivot hole 66 upwards until it is biased against the second end 69 of the trigger pivot hole 66. The upward motion changes the geometry of the relationship between the sear 62 and the hammer 40 allowing the point 72 of the sear 62 to clear the half-cock notch 48 and the full-cock notch 50 as the hammer 40 is cocked. The point 72 of the sear 62 first slips into the half-cock notch 48 of the hammer 40. At this time, the rifle is considered in a safe condition because the point 72 of the sear 62 is locked into the half-cock notch 48 and the one-piece trigger 60 cannot be pulled to release the hammer 40, which is biased rearward under spring pressure (not shown), to strike the firing pin (not shown). If the cocking motion is continued, the hammer 40 continues to pivot around the hammer screw 42 and the point 72 of the sear 62 next slips into the full-cock notch 50. When the hammer 40 is cocked to either the half-cock position or the full-cock position pressure from a compressed mainspring 54 puts pressure on the one-piece trigger 60 again biasing it against the first end 67 of the trigger pivot hole 66. When the one-piece trigger 60 is in this position it cannot clear the half-cock notch 48 or the full-cock 50 and thus, it is unable to release the hammer 40 to strike the firing pin (not shown) until the trigger safety block 80 is deactivated by the closing of the lever (not shown). When the lever (not shown) is closed deactivating the trigger safety block 80 the rifle (not shown) is then ready to fire when the shooter pulls the one-piece trigger 60 by putting finger pressure on the trigger shoe 64 to cause the one-piece trigger 60 to pivot on the trigger pin 68 and release the point 72 of the sear 62 from the full-cock notch 50 of the hammer 40. When the sear 62 is released the hammer 40 is propelled under pressure of the main spring 54 pushing forward on a hammer rod 52 to pivot forward on the hammer screw 42 and strike the firing pin (not shown) discharging the weapon. The trigger safety block 80 shown in FIGS. 1, 2 & 3 consists of a spring loaded bar hingeably attached to the trigger guard plate 20. When the trigger safety block 80 is in the down position the end of said trigger safety block 80 contacts the rear surface 65 of the trigger 60 preventing said trigger 60 from being pulled. When the lever (not shown) is fully closed, it pushes the trigger safety block 80 into its up position causing the trigger safety block 80 to cease to contact the rear surface 65 of the trigger 60 and allowing the trigger 60 to be pulled causing the rifle to fire.

Figure 9:
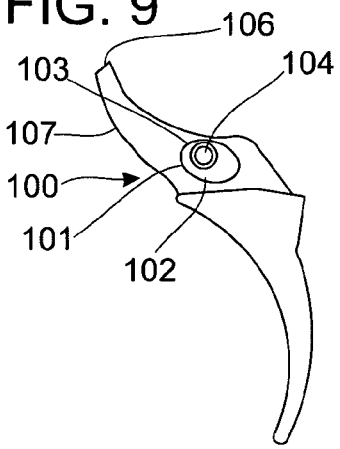
FIG. 9 is a pen and ink drawing showing an alternative embodiment of the invention.

An alternative embodiment of the present invention shown in FIG. 9 is a one-piece trigger 100 manufactured having a trigger pivot hole 101 that is cut oversize. Molded inside the trigger pivot hole 101 is a polymer or elastomeric bushing 102 with a metal insert 103 through which a trigger pin 104 is inserted. As the hammer (not shown) is cocked the polymer or elastomeric bushing 102 will flex allowing a point 106 of a sear 107 to clear the half cock notch (not shown) and the full cock notch (not shown) of the hammer (not shown). The plastic or elastomeric bushing 102 would then flex back into its original position under spring pressure from the hammer spring (not shown) and function essentially the same as the one-piece trigger 60 with the oblong pivot hole 66 (FIG. 1) that is described above.

Figure 10:
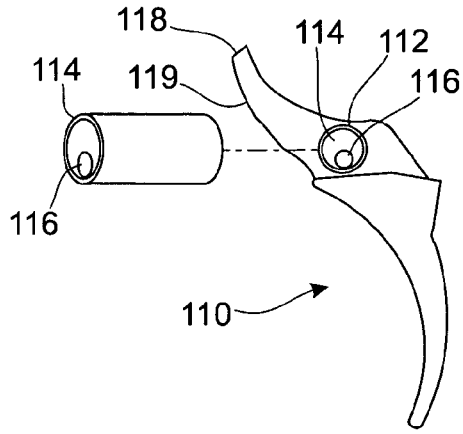
FIG. 10 is a pen and ink drawing showing another alternative embodiment of the invention.

Another alternative embodiment of the present invention shown in FIG. 10 is a one-piece trigger 110 is manufactured having a trigger pivot hole 112 that is round in shape and cut oversize. Inside the trigger pivot hole 112 is a movable metal bushing 114 with an offset pivot hole 116. In operation the movable metal bushing 114 would rotate to allow a point 118 of a sear 119 to clear the half cock notch (not shown) and the full cock notch (not shown) as the hammer (not shown) is cocked.

Figure 8:
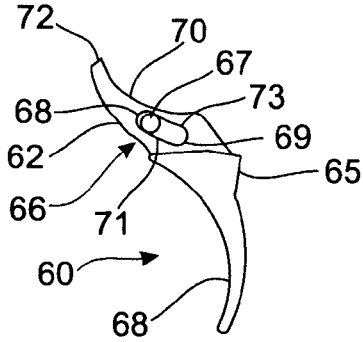
FIG. 8 is a pen and ink drawing showing the preferred embodiment of the invention by itself.
Figure 11:
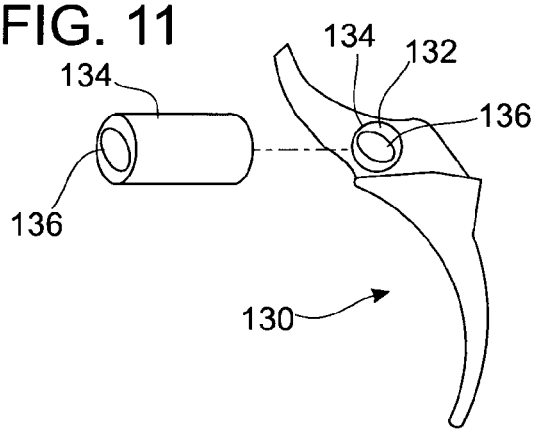
FIG. 11 is a pen and ink drawing showing yet another alternative embodiment of the invention.
Figure 12:
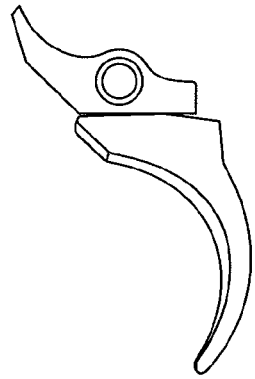
FIG. 12 PRIOR ART
FIG. 12 is a pictorial illustration of the prior art WILD-WEST GUNS™ HAPPY TRIGGER™

Yet another alternative embodiment of the present invention shown in FIG. 11 is a one-piece trigger 130 manufactured having a trigger pivot hole 132 that is round in shape and cut oversize. Inserted in the trigger pivot hole 132 is a tightly fitted metal bushing 134 with an oval or elliptically shaped hole 136. The oval or elliptically shaped hole 136 would be dimensioned identically and function identically to the trigger pivot hole 66 of the one-piece trigger 60 as shown in FIG. 8.

Figure 13:
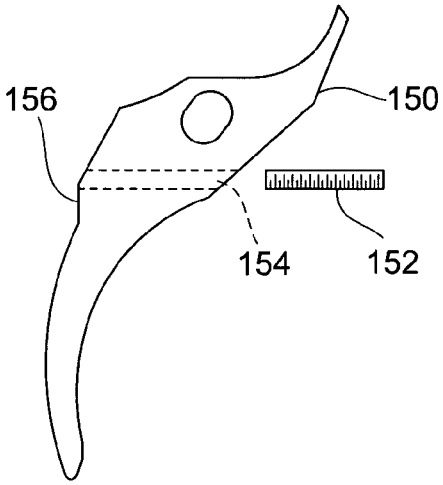
FIG. 13 is an exploded view of a further embodiment of the present invention incorporating a set screw for the adjustment of the trigger safety block.
Figure 14:
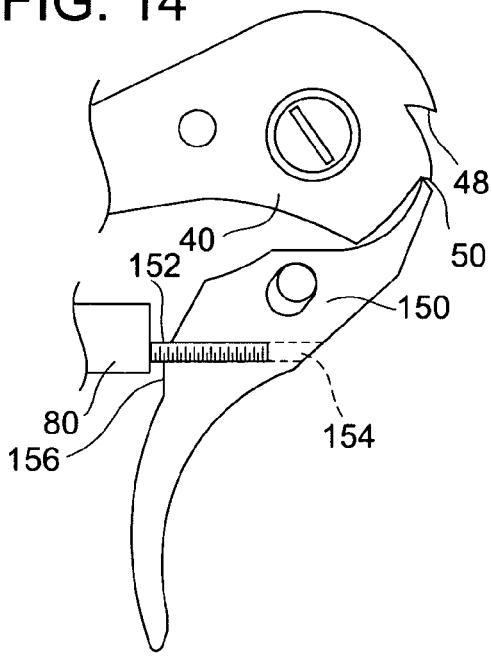
FIG. 14 is a further illustration of the present invention incorporating a set screw for the adjustment of the trigger safety block.

Still another alternative embodiment of the present invention shown in FIGS. 13 and 14 is a one piece trigger 150 manufactured having a set screw 152 inserted in a threaded hole 154 wherein the set screw 152 can be screwed in or out to tune the interaction of the rear surface 156 of the trigger 150 with the trigger safety block 80 so that the trigger may be easily fitted to the trigger safety block 80 without having to machine and polish the rear surface 65 or the trigger safety block 80.

Yet another alternative embodiment of the present invention (not shown) would include an over travel adjustment screw for the adjustment or elimination of trigger over travel.

Changes may be made in the combination, operations, and arrangements of various parts and elements described herein without departing from the spirit and scope of the invention.

PARTS LIST

10 Trigger Group
20 Trigger Plate
40 Hammer
60 One Piece Trigger
40 Hammer
42 Hammer Screw
44 Hammer Spur

46 Convex Surface
48 Half-cock Notch
50 Full Cock Notch
52 Hammer Rod
54 Mainspring
60 Trigger
62 Sear
64 Trigger Shoe
65 Rear Surface
66 Trigger Pivot Hole
67 First End
68 Trigger Pin
69 Second End
70 Concave Surface
71 Bottom Surface
72 Point
73 Top Surface
80 Trigger Safety Block
90 Prior Art Trigger Mechanism
94 Prior Art Trigger
96 Prior Art Trigger Hole
99 Pivot Art Sear
100 Trigger w/t Polymer Bushing
102 Polymer Bushing
103 Metal Insert
104 Trigger Pin
106 Point
107 Sear
110 Trigger w/t Movable Bushing and Offset Hole
112 Trigger Pivot Hole
114 Metal Bushing
116 Offset Pivot Hole
118 Point
119 Sear
130 Trigger w/t Oblong Hole in Bushing
132 Trigger Pivot Hole
134 Metal Bushing
136 Oval Hole
150 Trigger with Set Screw Adjustment
152 Set Screw
154 Threaded Hole
156 Rear Surface

What is claimed is:

1. A one piece trigger for a lever action rifle having a hammer mounted for pivotal movement from an uncocked position through a half cocked position to a cocked position, said hammer having a convex surface which rotates against a concave surface of a sear on the trigger, the convex surface of the hammer having a half cock notch and a full cock notch cut into its surface such that a point on the sear will click into one of the half cock notch or the full cock notch as the hammer is cocked or rotatably biased back against a mainspring thereby holding the hammer in either its half cocked or its cocked position, said rifle being safe when the hammer is cocked to the half cock position and capable of being fired when the hammer is cocked to the full cock position and the trigger is pulled to release the sear from the full cock notch allowing the hammer to rotate forward under pressure from the mainspring and strike the firing pin wherein:

Said trigger has an elliptically shaped trigger pivot hole and a round trigger pin which allows the trigger to change positions by sliding on the trigger pin as the hammer is cocked so that the point of the sear clears the half cock and full cock notches on the hammer allowing the hammer to be cocked and then slip back into its original position under pressure from the mainspring after the point of the sear clicks into the half cock or full cock notch such that the point of the sear cannot clear the half cock or full cock notch unless the trigger is pulled.

2. The one piece trigger of claim 1 wherein: the mainspring biases the round trigger pin against the first end of the elliptical trigger pivot hole when the trigger is at rest, and as the trigger is cocked, the trigger slides up until the round trigger pin is biased against the second end of the elliptical trigger pivot hole allowing the point of the sear to slip past the half and full cock notches and once the point of the sear clicked in either the half cock or full cock notch the trigger pin is again biased against the first end of the trigger pivot hole locking the point of the sear in the half cock until the trigger is fully cocked and locking the point of the sear in the full cock notch when the hammer is fully cocked until the trigger is pulled.

3. A one piece trigger for a lever action rifle having a hammer mounted for pivotal movement from an uncocked position through a half cocked position to a cocked position, said hammer having a convex surface which rotates against a concave surface of a sear on the trigger, the convex surface of the hammer having a half cock notch and a full cock notch cut into its surface such that a point on the sear will click into one of the half cock notch or the full cock notch as the hammer is cocked or rotatably biased back against a mainspring thereby holding the hammer in either its half cocked or its cocked position, said rifle being safe when the hammer is cocked to the half cock position and capable of being fired when the hammer is cocked to the full cock position and the trigger is pulled to release the sear from the full cock notch allowing the hammer to rotate forward under pressure from the mainspring and strike the firing pin wherein:

Said trigger has an elliptically shaped trigger pivot hole and a round trigger pin which allows the trigger to change positions by sliding on the trigger pin as the hammer is cocked so that the point of the sear clears the half cock and full cock notches on the hammer allowing the hammer to be cocked and then slip back into its original position under pressure from the mainspring after the point of the sear clicks into the half cock or full cock notch such that the point of the sear cannot clear the half cock or full cock notch unless the trigger is pulled;

Said trigger also having a trigger shoe with a threaded hole passing through the trigger shoe such that a set screw protrudes from the rear surface and may be adjusted inwardly and outwardly allowing a simple method of adjustment of the tolerances and relationship between the rear surface of the trigger and a trigger safety block.

4. The one piece trigger of claim 2 wherein: the mainspring biases the round trigger pin against the first end of the elliptical trigger pivot hole when the trigger is at rest, and as the trigger is cocked, the trigger slides up until the round trigger pin is biased against the second end of the elliptical trigger pivot hole allowing the point of the sear to slip past the half and full cock notches and once the point of the sear clicked in either the half cock or full cock notch the trigger pin is again biased against the first end of the trigger pivot hole locking the point of the sear in the half cock until the trigger is fully cocked and locking the point of the sear in the full cock notch when the hammer is fully cocked until the trigger is pulled.

* * * * *